US010053930B2

(12) United States Patent
Marsh et al.

(10) Patent No.: US 10,053,930 B2
(45) Date of Patent: Aug. 21, 2018

(54) TRACK ASSEMBLY FOR DRILLING DRIVE SYSTEM

(71) Applicant: CATERPILLAR INC., Peoria, IL (US)

(72) Inventors: Richard Griffith Marsh, Lugoff, SC (US); Gabriel John Ellicott, Peoria Heights, IL (US); Michael H. Noble, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 469 days.

(21) Appl. No.: 14/832,712

(22) Filed: Aug. 21, 2015

(65) Prior Publication Data

US 2017/0051566 A1 Feb. 23, 2017

(51) Int. Cl.
*E21B 19/08* (2006.01)
*E21B 7/02* (2006.01)

(52) U.S. Cl.
CPC ..... *E21B 19/08* (2013.01); *E21B 7/02* (2013.01)

(58) Field of Classification Search
USPC ..... 173/184
See application file for complete search history.

(56) References Cited

U.S. PATENT DOCUMENTS

| | | | | |
|---|---|---|---|---|
| 2,301,887 | A * | 11/1942 | Lamb | E21B 19/084 173/147 |
| 2,406,546 | A * | 8/1946 | Selwyne | B65D 88/68 15/104.096 |
| 5,779,321 | A | 7/1998 | Coleman et al. | |
| 8,671,626 | B1 | 3/2014 | Marty et al. | |
| 2008/0149395 | A1 | 6/2008 | Fossbakken et al. | |
| 2009/0008615 | A1 | 1/2009 | Young et al. | |

* cited by examiner

*Primary Examiner* — Michelle Lopez
(74) *Attorney, Agent, or Firm* — Finnegan, Henderson, Farabow, Garrett & Dunner, LLP

(57) ABSTRACT

A drilling drive system is provided. The drilling drive system has a mast having a longitudinal axis and a surface extending along the longitudinal axis. A bar is fixed to the surface of the mast and extends along the longitudinal axis. A plurality of rungs is disposed along the length of the bar, and a floating chain is disposed around the mast. A drive sprocket has a plurality of teeth that engage the plurality of rungs and the floating chain.

19 Claims, 5 Drawing Sheets

TRACK ASSEMBLY FOR DRILLING DRIVE SYSTEM

TECHNICAL FIELD

The present disclosure relates generally to a drive system for a drilling surface and, more particularly, to a track assembly of the drive system.

BACKGROUND

Surface drilling rigs are used to drill bores or install bolts in a mine or tunnel. A drilling rig is typically provided with a mast structure extending from a foundation. The mast structure supports a drilling bit that is lowered into and removed from a wellbore.

One type of drive system used in a typical drill rig is a chain drive system. In a chain drive system, a drive sprocket engages with chains to enable lifting and lowering of the drilling bit. More specifically, the drive sprocket engages with two chains: one that floats, and one that remains stationary with respect to the mast during the drilling operation. Unfortunately, such chain drive systems can be uneconomical due to the design of the chains in the chain drive system. Specifically, before use, the fixed chain section will need to be attached to the mast. This requires a series of L-shaped brackets to be typically separately and manually welded first to the chain and then to the mast. Additionally, welding the brackets to the chain requires individual alignment of each bracket with each side of the chain before welding the bracket on both sides of the chain. This setup process is often time consuming and associated with high monetary and material costs.

One method of addressing the uneconomical nature of present chain drive systems is described in U.S. Patent Application Publication No. 2009/0008615 (the '615 application) authored by Young et al. and published on Jan. 8, 2009. The '615 application describes a roller chain and sprocket system that enables an improved transfer of energy between the sprocket and the chain during operation. Specifically, the '615 application describes a system in which the teeth of the sprocket have an involute profile that engage rollers in the roller chain. The interconnectivity of these components renders the system more operationally efficient, this leading to greater operational economy.

Although the system of the '615 application may help to reduce the uneconomical nature of typical chain drive systems, the system does not address the inefficiencies associated with fixing the chain section to the mast before system operation. Thus, significant time and cost inefficiencies are associated with the chain system of the '615 application.

The disclosed system is directed to overcoming one or more of the problems set forth above.

SUMMARY

In one aspect, the present disclosure is directed to a drilling drive system including a mast having a longitudinal axis and a surface extending along the longitudinal axis. The drilling drive system also includes a bar fixed to the surface of the mast and extending along the longitudinal axis. The drilling drive system further includes a plurality of rungs disposed along the length of the bar, a floating chain disposed around the mast, and a drive sprocket having a plurality of teeth configured to engage the plurality of rungs and the floating chain.

In another aspect, the present disclosure is directed to a drilling drive system including a mast having a longitudinal axis and a surface extending along the longitudinal axis. The drilling drive system also includes a bar fixed to the surface of the mast and extending along the longitudinal axis and a plurality of rungs each coupled to the bar at a curved surface of each of the plurality of rungs. The drilling drive system further includes a floating chain disposed around the mast and a drive sprocket comprising a plurality of teeth configured to engage the plurality of rungs and the floating chain.

In another aspect, the present disclosure is directed to a drilling rig including a mast having a longitudinal axis and a surface disposed along the longitudinal axis. The drilling rig also includes a bar fixed to the surface of the mast and extending along the longitudinal axis and a plurality of rungs welded to the bar along the length of the bar. The drilling rig further includes a drive sprocket having a plurality of teeth configured to engage the plurality of rungs as the drive sprocket moves along the length of the bar. The drilling rig also includes a floating chain configured to engage the plurality of teeth of the drive sprocket and move with respect to the mast and a drill coupled to the floating chain and configured to move in response to movement of the drive sprocket and the floating chain.

DETAILED DESCRIPTION

Figure 1:
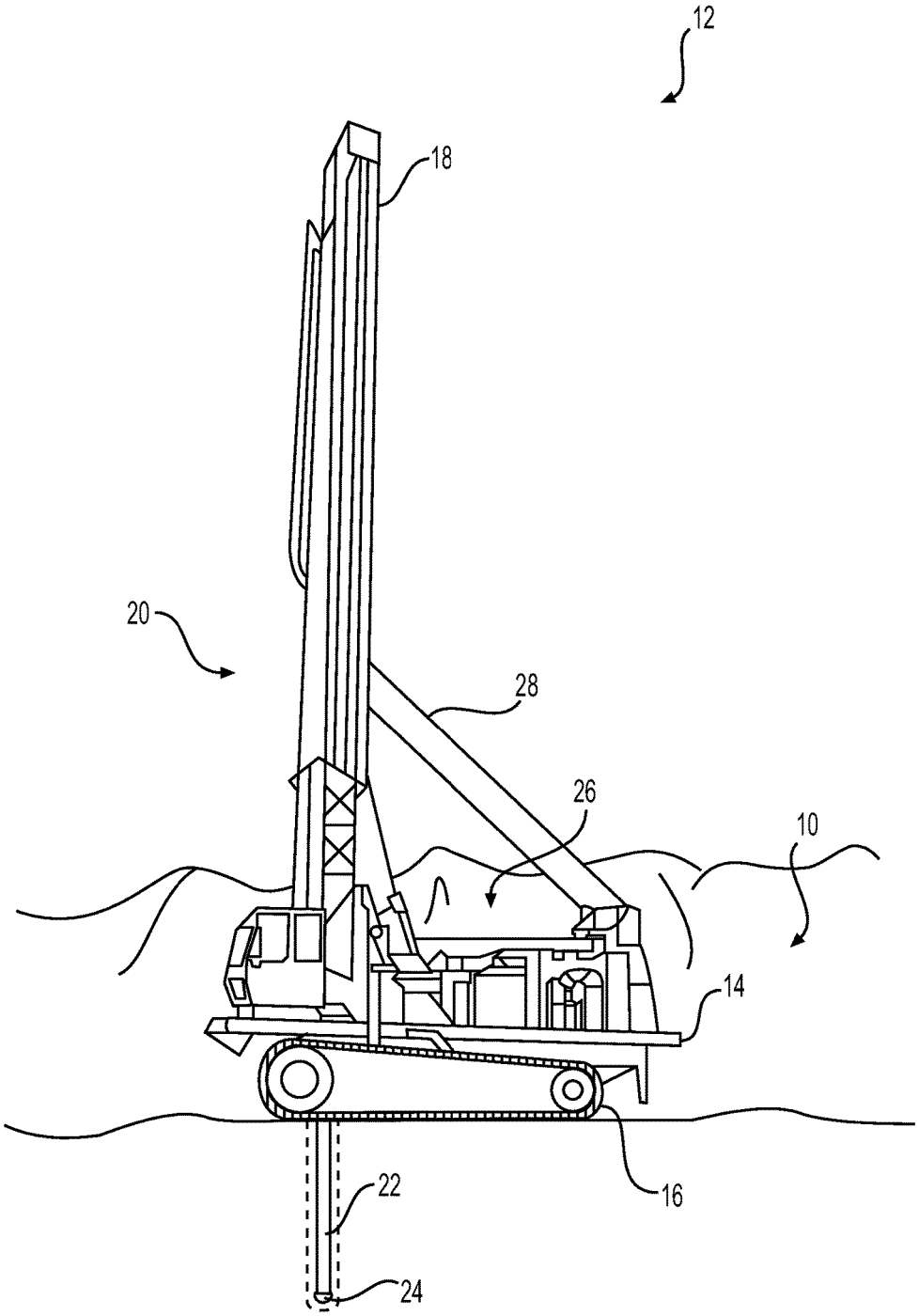
FIG. 1 is a diagrammatic illustration of an exemplary drilling rig.

FIG. 1 illustrates an exemplary worksite 10. The worksite 10 may support a number of operations, including, for example, a drilling operation. The drilling operation may be performed by a machine 12, which may be directed to drilling holes in a surface of the worksite 10. Explosives may subsequently be placed in the drilled holes for blasting. After detonating the explosives, loose material remaining in the location of the blasting may be hauled away for removal purposes and/or processing.

The machine 12 may be a mobile machine configured to drill holes (e.g., a drill rig). The machine 12 includes a mobile platform 14 configured to provide a supporting framework for one or more components of the machine 12. The mobile platform 14 may be coupled to a power source (not shown), such as a diesel or gas powered engine. It is also contemplated that the power source may be located remotely from the machine 12. Specifically, the power source may embody a generator that is coupled to a motor of the machine 12 by a length of power cable.

The machine 12 may also include a plurality of ground engaging devices 16. The ground engaging devices 16 are configured to engage the worksite surface and propel the mobile platform 14. The ground engaging devices 16 may include tracks, wheels, or any other ground engaging device known in the art. In the embodiment of FIG. 1, the machine 12 includes two ground engaging devices 16, one located on either side of the machine 12. It is contemplated, however, that the machine 12 may have any appropriate number of the ground engaging devices 16.

The machine 12 also includes a mast 18 coupled to the mobile platform 14. The mast 18 may be a frame configured to hold a drill 20 and enable the drill 20 to penetrate into the worksite surface. The drill 20 may include a drill pipe 22, a drill bit 24, and a motor 26 that is configured to rotate the drill bit 24. It is contemplated that the motor 26 may be, for example, a hydraulic or electric motor powered by the power source. To that end, the motor 26 may be coupled to one or more hydraulic lines 29 (shown in FIG. 2) in some embodiments. It is further contemplated that the motor 26 may be omitted, and the drill 20 may be driven by the power source via one or more belts and/or gear trains.

Figure 2:
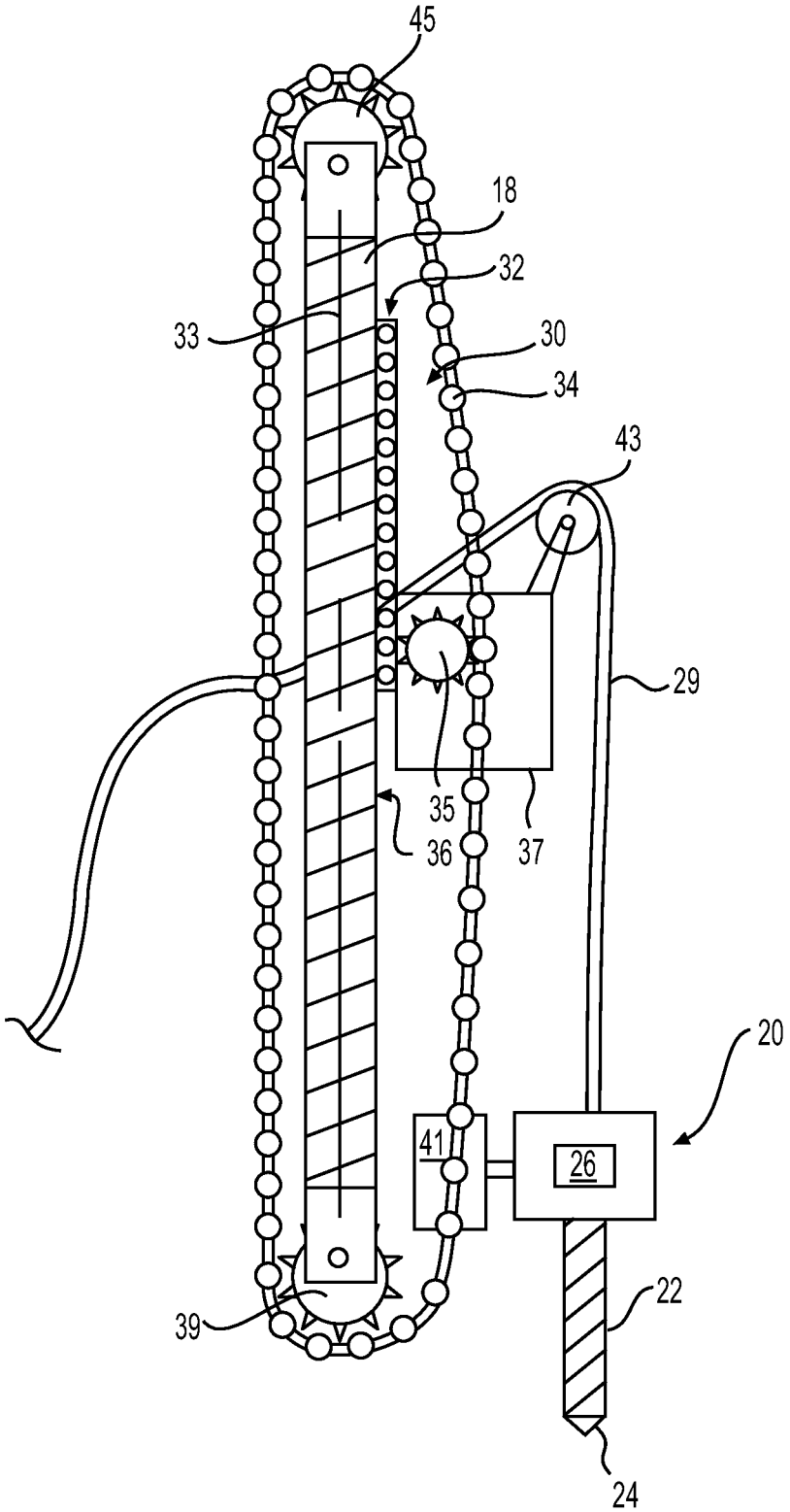
FIG. 2 is a diagrammatic illustration of an exemplary chain drive system that may be used with the drilling rig of FIG. 1.

The mast 18 may also be configured to interface with a drilling drive system 30 that enables movement of the drill 20, for example, in and out of a wellbore. As shown in FIG. 2, the drilling drive system 30 includes the mast 18, a track assembly 32 extending along a longitudinal axis 33 of the mast 18, a floating chain 34, and a drive sprocket 35 housed in a housing 37. The floating chain 34 is supported by a first idler sprocket 45 coupled to a top portion of the mast 18 and a second idler sprocket 39 coupled to a bottom portion of the mast 18. Each of the idler sprockets 45 and 39 are configured to rotate and support the floating chain 34 as the floating chain 34 moves around the mast 18.

The floating chain 34 is further coupled to the drill 20 via a bracket 41 to enable movement of the drill 20 up and down as the floating chain 34 is driven around the idler sprockets 45 and 39 by the drive sprocket 35. As the drill 20 is driven in this manner, the hydraulic lines 29 are supported by a pulley 43 coupled to the housing 37. The hydraulic lines 29 may then extend to a downstream location, for example, to a source of hydraulic fluid.

The track assembly 32 and the floating chain 34 are configured to mate with opposing edges of the drive sprocket 35 during operation to enable movement of the drill 20. The track assembly 32 may be directly coupled to an inner surface 36 of the mast 18 to fix the relative position of the track assembly 32 and the mast 18 during movement of the drive sprocket 35 and its housing 37.

As the drive sprocket 35 engages the track assembly 32, the rotation of the drive sprocket 35 causes the drive sprocket 35 to move up and down the longitudinal axis 33 of the mast 18. In addition, rotation of the drive sprocket 35 also drives the movement of the floating chain 34 around the idler sprockets 45 and 39. The movement of the floating chain 34 results in movement of the drill 20 and the pulley 43 up and down. During this movement, the floating chain 34 may be configured to move at approximately two times the speed of the drive sprocket 35 to enable the pulley 43 to handle slack generated in the hydraulic lines 29 as the drill 20 moves. Further, brackets 21 and 23 may be provided in some embodiments to guide the movement of the floating chain 34, as shown in FIG. 3.

The mast 18 may be constructed of steel or any other appropriate material. The mast 18 may be directly pivotably connected to the mobile platform 14 and may be pivoted by way of one or more hydraulic actuators 28 (referring to FIG. 1). Alternatively, the mast 18 may be pivotably connected to the mobile platform 14 by way of a boom (not shown). It is contemplated that the hydraulic actuators 28 may position the mast 18 perpendicular to the mobile platform 14 in an extended configuration and parallel to the mobile platform 14 in a retracted configuration.

Figure 3:
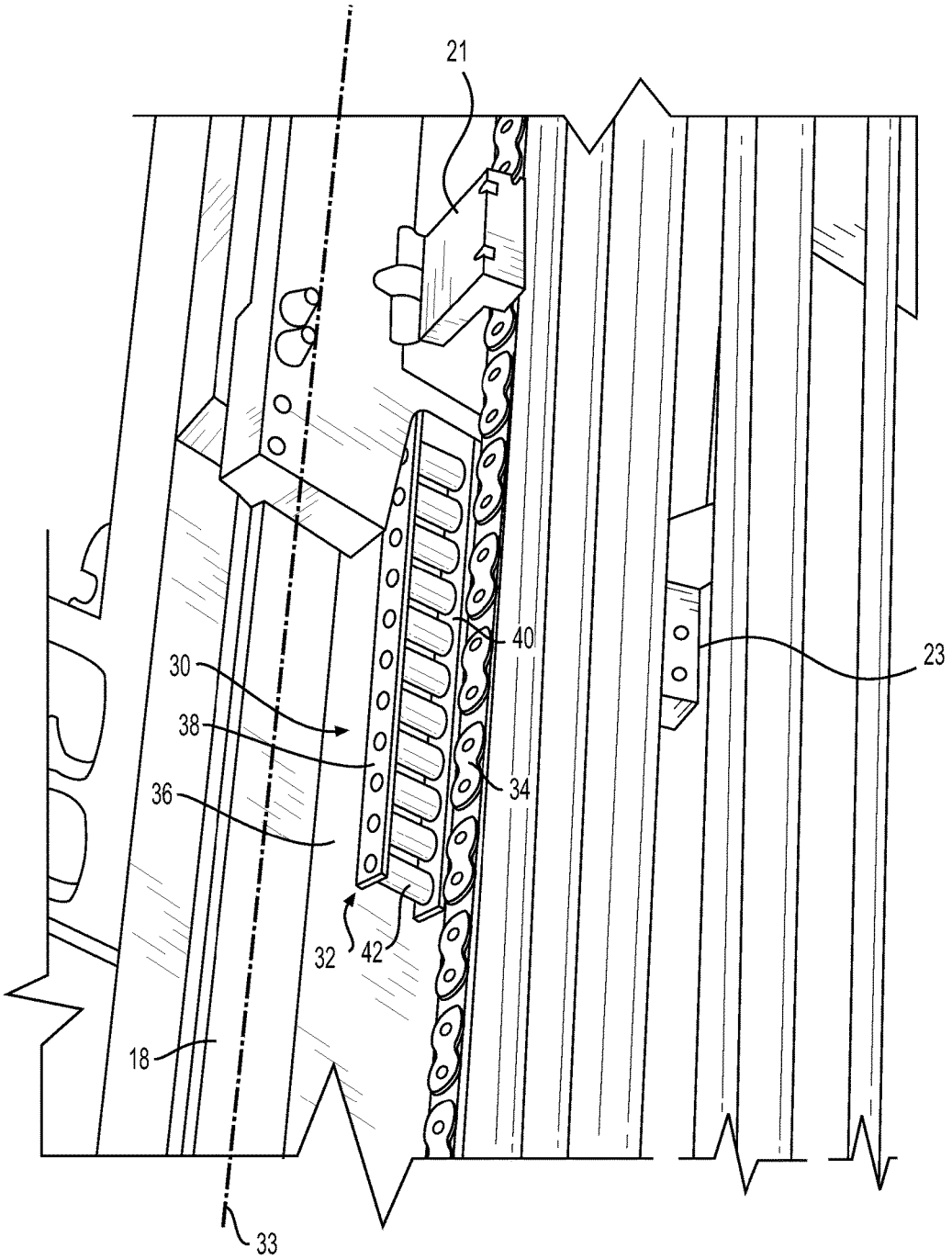
FIG. 3 is a cutaway illustration of a chain drive system that may be used with the drilling rig of FIG. 1.

As shown in FIG. 3, the track assembly 32 may be directly coupled to an inner surface 36 of the mast 18 to fix the relative position of the track assembly 32 and the mast 18 during operation. As used herein, "directly coupled" means that the attachment between one component and a second component is not enabled by an additional structure (e.g., a bracket). Instead, the attachment mechanism enables the first and second components to remain in contact with each other without the use of additional structures. For example, in one embodiment, the track assembly 32 may be directly coupled to the inner surface 36 of the mast 18 via welding.

In the illustrated embodiment, the track assembly 32 includes a first bar 38, a second bar 40, and a plurality of rungs 42 extending between the first and second bars 38, 40. The first and second bars 38, 40 may be positioned to extend along the longitudinal axis 33 of the mast 18. In some embodiments, the first bar 38, the second bar 40, and the plurality of rungs 42 may be formed as an integrated assembly or as a single piece, depending on implementation-specific considerations. For example, the first bar 38, the second bar 40, and/or the plurality of rungs 42 may be cast together, formed separately and then welded, or machined from a monolithic block of material. Further, the first and second bars 38, 40 and the plurality of rungs 42 may be formed of any suitable rigid material, such as steel. Additionally, it is contemplated that in some embodiments, the first bar 38 and/or the second bar 40 may be omitted, if desired. For example, the plurality of rungs 42 may be individually welded directly to the mast 18. Further, the plurality of rungs 42 may have any cross-sectional shape (e.g., circular, oval, square, triangular, etc.) and/or may have a uniform or varying shape and/or size.

Figure 4:
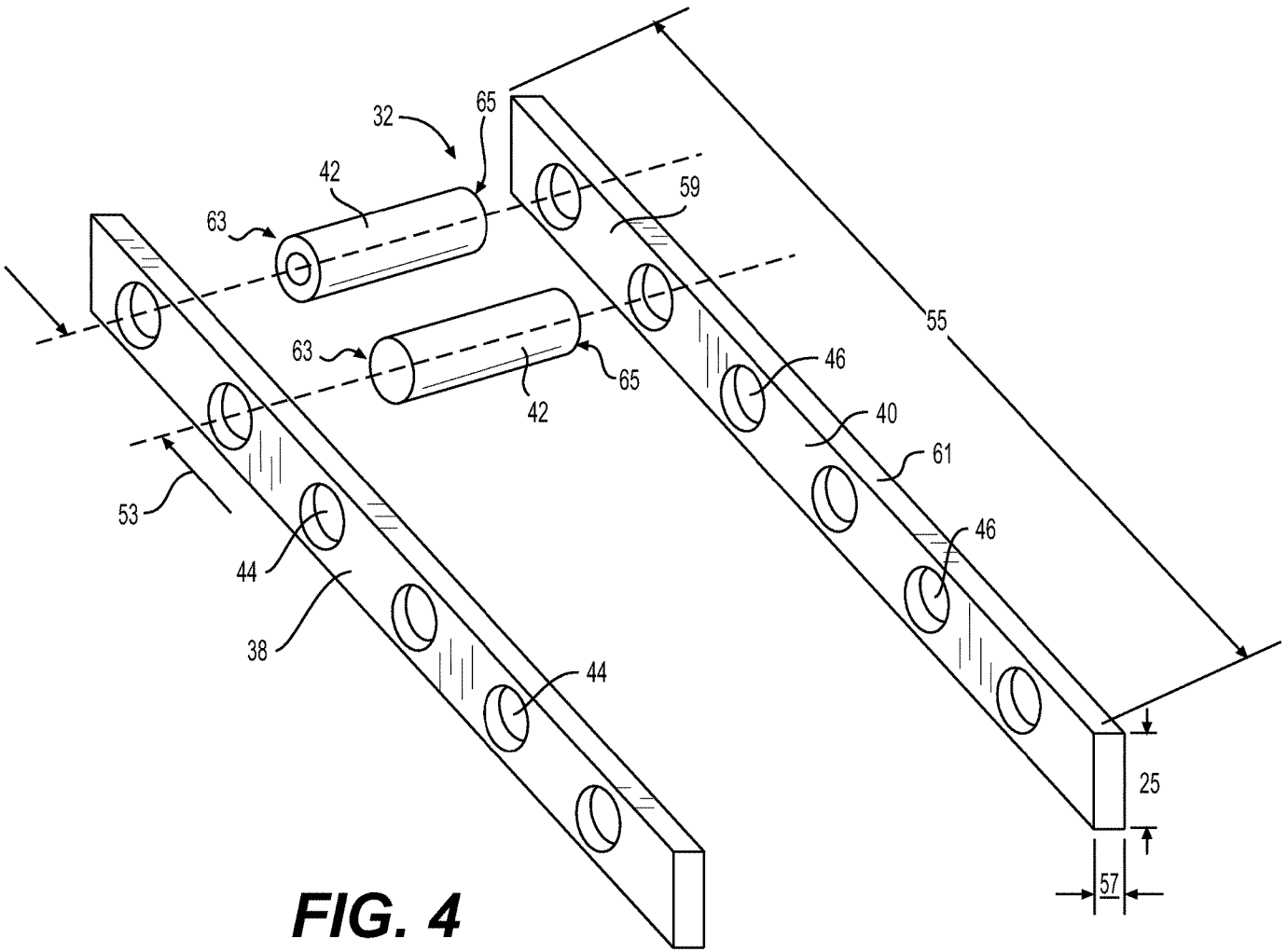
FIG. 4 is an exploded view illustration of an exemplary track assembly that may be used with the chain drive system of FIG. 3.

FIG. 4 is an exploded diagrammatic view of an embodiment of the track assembly 32 of FIG. 2. In this embodiment, the first and second bars 38, 40 are formed as parallel rails and are substantially identical. Each of the bars 38, 40 includes a plurality of apertures 44 formed along a side face 59 thereof. In some embodiments, a pitch 53 between adjacent apertures 44 may be selected to match a pitch 56 of the drive sprocket 35, thus enabling the drive sprocket 35 to mate with the plurality of rungs 42 during operation.

In the illustrated embodiment, each of bars 38, 40 has a rectangular cross section with a width 57 of each bar 38, 40, a length 55 narrower than the width 57, and a height 25. Each bar 38, 40 also includes a side face 61 extending along the length 55. The side face 61 of each bar 38, 40 is configured to be positioned adjacent the inner surface 36 of the mast 18 when attached thereto, as shown in FIG. 3.

The plurality of rungs 42, in this embodiment, have a generally circular cross section, with a first end 63 and a second end 65, respectively, configured to be received in the plurality of apertures 44, 46 at the side face 59 of the bars 38, 40. Some or all of the plurality of rungs 42 may be formed as hollow tubular or solid cylindrical bars, as shown for the rungs 42 in FIG. 4.

Any suitable method of coupling the plurality of rungs 42 to the first and second bars 38, 40 may be utilized, depending on implementation-specific considerations. For example, the plurality of rungs 42 may be press-fitted, welded, shrink-fitted, riveted, and/or threaded, to the bars 38, 40. Further, in some embodiments, the bars 38, 40 may be provided without the plurality of apertures 44, 46, and the ends 63, 65 of the plurality of rungs 42 may be butted up against the side face 59 of the bars 38, 40.

Figure 5:
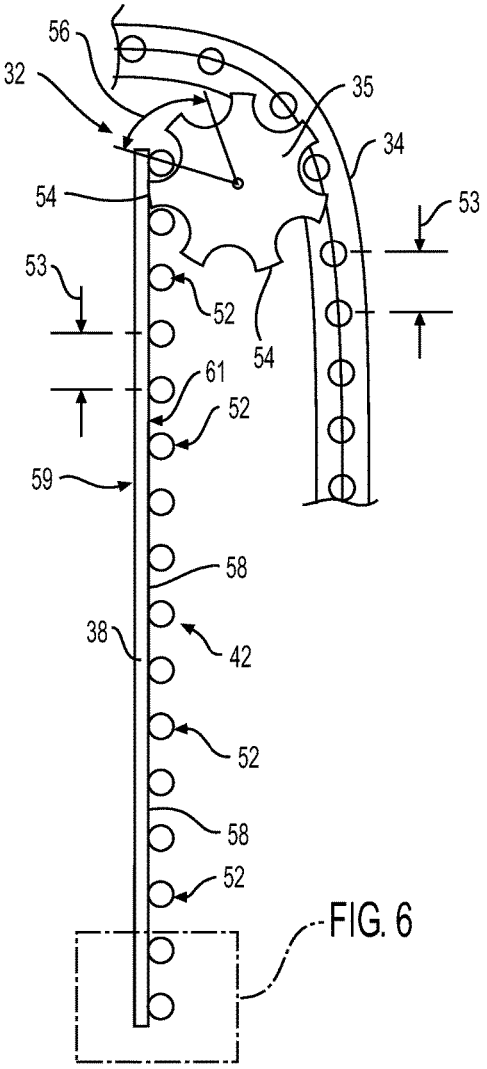
FIG. 5 is a diagrammatic and side view illustration of an exemplary track assembly that may be used with the chain drive system of FIG. 3.

FIG. 5 is a diagrammatic and side view illustration of another embodiment of the track assembly 32 interfacing with the drive sprocket 35 and the floating chain 34. In this embodiment, the bar 38 is rotated 90 degrees with respect to the previous embodiments, such that the side face 59 is configured to be adjacent to the inner surface 36 of the mast 18. Further, in this embodiment, the plurality of rungs 42 are attached to the side face 61 of the bar 38 along a curved surface 52 of each of the plurality of rungs 42.

As described above, the drive sprocket 35 is configured to mate with the track assembly 32 and the floating chain 34. To that end, the drive sprocket 35 includes a plurality of teeth 54 arranged at a pitch 56 configured to match the pitch 53 of the track assembly 32 and the floating chain 34. As the drive sprocket 35 moves along the length of the track assembly 32 and moves with the floating chain 34, the plurality of teeth 54 engage a plurality of spaces 58 between the plurality of rungs 42.

Figure 6:
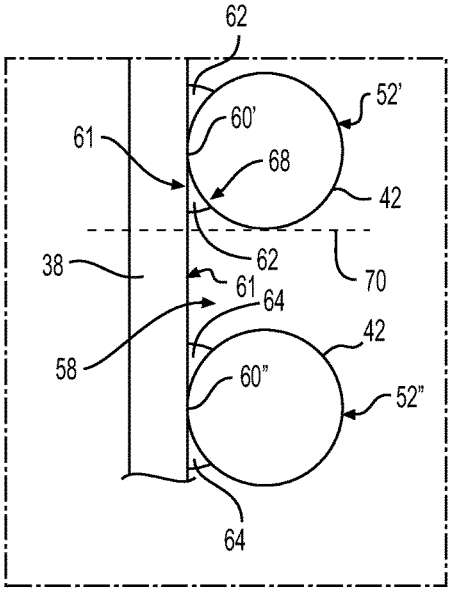
FIG. 6 is a cutaway illustration of an exemplary portion of the track assembly of FIG. 5.

FIG. 6 is a cutaway view of a portion of the track assembly 32 depicting features of the plurality of spaces 58 between adjacent rungs 42. As shown, in this embodiment, each of the rungs 42 are connected to bar 38 at a generally flat interface 60' and 60". This flat interface 60' and 60" may be formed in a number of different ways. For example, the flat interface 60' and 60" may include a line engagement between the rungs 42 and surface 61, along with wedges of weld material 62, 64 deposited at opposing sides of the line engagement. In some embodiments, the wedges of weld material 62, 64 may be bounded by line 70 to reduce or prevent the likelihood of the drive sprocket 35 contacting the weld material 62, 64 during operation. In other embodiments, the rungs 42 may be flattened somewhat such that a rectangular engagement between the rungs 42 and the surface 61 is created and the curved surfaces 52' and 52" are flattened.

INDUSTRIAL APPLICABILITY

The disclosed drive systems, including the track assembly 32 and the mast 18, may have a variety of industrial applications. For example, the disclosed systems may have industrial applicability in systems that require the lifting and lowering of a load, such as drilling operations. The disclosed systems may enable improvements in the uneconomical nature of chain drive systems by reducing the time and cost associated with positioning the track assembly 32 in a fixed position with respect to the mast 18.

One exemplary operation of the drive system having the track assembly 32 and the mast 18 will now be explained. During operation of the drive system, the drive sprocket 35 rotates in response to a torque delivered to the drive sprocket 35, for example, from a driving mechanism, such as a hydraulic motor. As the drive sprocket 35 rotates, the teeth 54 move along the track assembly 32 engaging the plurality of rungs 42 and propelling the drive sprocket 35 and the housing 37 along the length of the mast 18. Rotation of the drive sprocket 35 also causes the floating chain 34 to move around the idler sprockets 45, 39, causing a load, such as the drill 20 that is attached to the floating chain 34, to lift and/or lower. As the drill 20 lifts and lowers, the hydraulic lines 29 spool over the pulley and enable slack in the hydraulic lines 29 to be accommodated.

Several advantages may be associated with the disclosed drive systems. For example, since the bar 38 may be a single piece instead of a multi-piece chain with several links, a single weld or other attachment mechanism may be used to secure the bar 38 to the mast 18. This enables the bar 38 to be directly coupled to the inner surface 36 of the mast 18. This direct coupling may further reduce the uneconomical nature of the task of manually aligning each chain link with each L-bracket when welding the chain drive system to the mast 18.

It will be apparent to those skilled in the art that various modifications and variations can be made to the disclosed systems. Other embodiments will be apparent to those skilled in the art from consideration of the specification and practice of the disclosed systems. For example, although described as having male spline features, the disclosed spline/counterweight component may have female spline features, if desired. It is intended that the specification and examples be considered as exemplary only, with a true scope being indicated by the following claims and their equivalents.

What is claimed is:

1. A drilling drive system, comprising:
- a mast having a longitudinal axis and a surface extending along the longitudinal axis;
- a bar fixed to the surface of the mast and extending along the longitudinal axis;
- a plurality of rungs disposed along the length of the bar;
- a floating chain disposed around the mast; and
- a drive sprocket comprising a plurality of teeth configured to engage the plurality of rungs and the floating chain.

2. The drilling drive system of claim 1, wherein:
- the bar is a first bar; and
- the drilling drive system further includes a second bar spaced apart from the first bar, extending along the longitudinal axis of the mast, being fixed to the surface of the mast, and being coupled to the plurality of rungs.

3. The drilling drive system of claim 2, wherein:
- each of the first bar and the second bar includes a plurality of apertures configured to receive the plurality of rungs; and
- ends of the plurality of rungs are located within the plurality of apertures.

4. The drilling drive system of claim 3, wherein a pitch between the plurality of apertures matches a pitch of the drive sprocket.

5. The drilling drive system of claim 4, further including:
- a first idler sprocket;
- a second idler sprocket; and
- wherein the floating chain is disposed around the first and second idler sprockets and configured to be driven with respect to the mast by the drive sprocket.

6. The drilling drive system of claim 2, wherein each of the plurality of rungs is coupled to the first and second bars at end portions of each of the plurality of rungs.

7. The drilling drive system of claim 1, wherein the bar has a rectangular cross section with two opposing side faces and two opposing edges, and is welded to the surface of the mast at a first of the two opposing side faces.

8. The drilling drive system of claim 1, wherein a curved surface at each of the plurality of rungs is welded to the bar.

9. The drilling drive system of claim 1, wherein each of the plurality of rungs is coupled to the bar via shrink-fitting, riveting, or threading.

10. A drilling drive system, comprising:
- a mast having a longitudinal axis and a surface extending along the longitudinal axis;
- a bar fixed to the surface of the mast and extending along the longitudinal axis;
- a plurality of rungs each coupled to the bar at a curved surface of each of the plurality of rungs;
- a floating chain disposed around the mast; and a drive sprocket comprising a plurality of teeth configured to engage the plurality of rungs and the floating chain.

11. The drilling drive system of claim 10, wherein the plurality of rungs are connected to the bar by welding.

12. The drilling drive system of claim 10, wherein the bar has a rectangular cross section with two opposing side faces and two opposing edges, and is welded to the surface of the mast at a first of the two opposing side faces.

13. The drilling drive system of claim 10, wherein each of the plurality of rungs is a solid bar.

14. The drilling drive system of claim 10, wherein each of the plurality of rungs is a hollow tubular bar.

15. The drilling drive system of claim 10, wherein the bar has a rectangular cross section with a width narrower than a length, and a side face disposed along the length.

16. The drilling drive system of claim 15, wherein each of the plurality of rungs is welded to the side face of the bar.

17. The drilling drive system of claim 10, wherein a pitch between the plurality of rungs equals a pitch of the drive sprocket.

18. The drilling drive system of claim 17, wherein the floating chain has a pitch equal to the pitch of the drive sprocket.

19. A drilling rig, comprising:

a mast having a longitudinal axis and a surface disposed along the longitudinal axis;

a bar fixed to the surface of the mast and extending along the longitudinal axis;

a plurality of rungs welded to the bar along the length of the bar;

a drive sprocket having a plurality of teeth configured to engage the plurality of rungs as the drive sprocket moves along the length of the bar;

a floating chain configured to engage the plurality of teeth of the drive sprocket and move with respect to the mast; and a drill coupled to the floating chain and configured to move in response to movement of the drive sprocket and the floating chain.

* * * * *